US007028618B2

(12) United States Patent
Wallner

(10) Patent No.: US 7,028,618 B2
(45) Date of Patent: Apr. 18, 2006

(54) RAIL SYSTEM FOR SUSPENSION CRANE AND PROFILE FOR SUCH RAIL SYSTEM

(75) Inventor: Manfred Josef Wallner, Tellstrasse 20, 42657, Solingen (DE)

(73) Assignee: Manfred Josef Wallner, Solingen (DE)

( * ) Notice: Subject to any disclaimer, the term of this patent is extended or adjusted under 35 U.S.C. 154(b) by 0 days.

(21) Appl. No.: 10/914,980

(22) Filed: Aug. 10, 2004

(65) Prior Publication Data

US 2005/0098059 A1 May 12, 2005

(30) Foreign Application Priority Data

Aug. 11, 2003 (DE) ..... 103 37 122

(51) Int. Cl.
*E01B 25/22* (2006.01)
*B61C 11/00* (2006.01)

(52) U.S. Cl. ..... 104/108; 105/29.1

(58) Field of Classification Search ..... 104/89, 104/90, 91, 93, 106, 108, 138.1, 139; 105/29.1
See application file for complete search history.

(56) References Cited

U.S. PATENT DOCUMENTS 6,233,878 B1 * 5/2001 Krahenbuhl et al. ..... 52/64

* cited by examiner

*Primary Examiner*—S. Joseph Morano
*Assistant Examiner*—Robert J. McCarry, Jr.
(74) *Attorney, Agent, or Firm*—Grossman Tucker Perreault & Pfleger, PLLC

(57) ABSTRACT

The invention concerns an overhead crane track which includes at least one crane track rail (1) and at least one carriage (2) guided on the crane track rail (1). The crane track rail (1) is composed of a plurality of portions of a hollow profile member. The carriage (2) is guided on a runway formed within the hollow profile member. The carriage (2) includes at least one electric drive which is supplied with power by way of a power feed provided within the hollow profile member. The carriage (2) is arranged displaceably by way of drive means arranged completely in the interior of the hollow profile member within same.

9 Claims, 6 Drawing Sheets

RAIL SYSTEM FOR SUSPENSION CRANE AND PROFILE FOR SUCH RAIL SYSTEM

Figure 1:
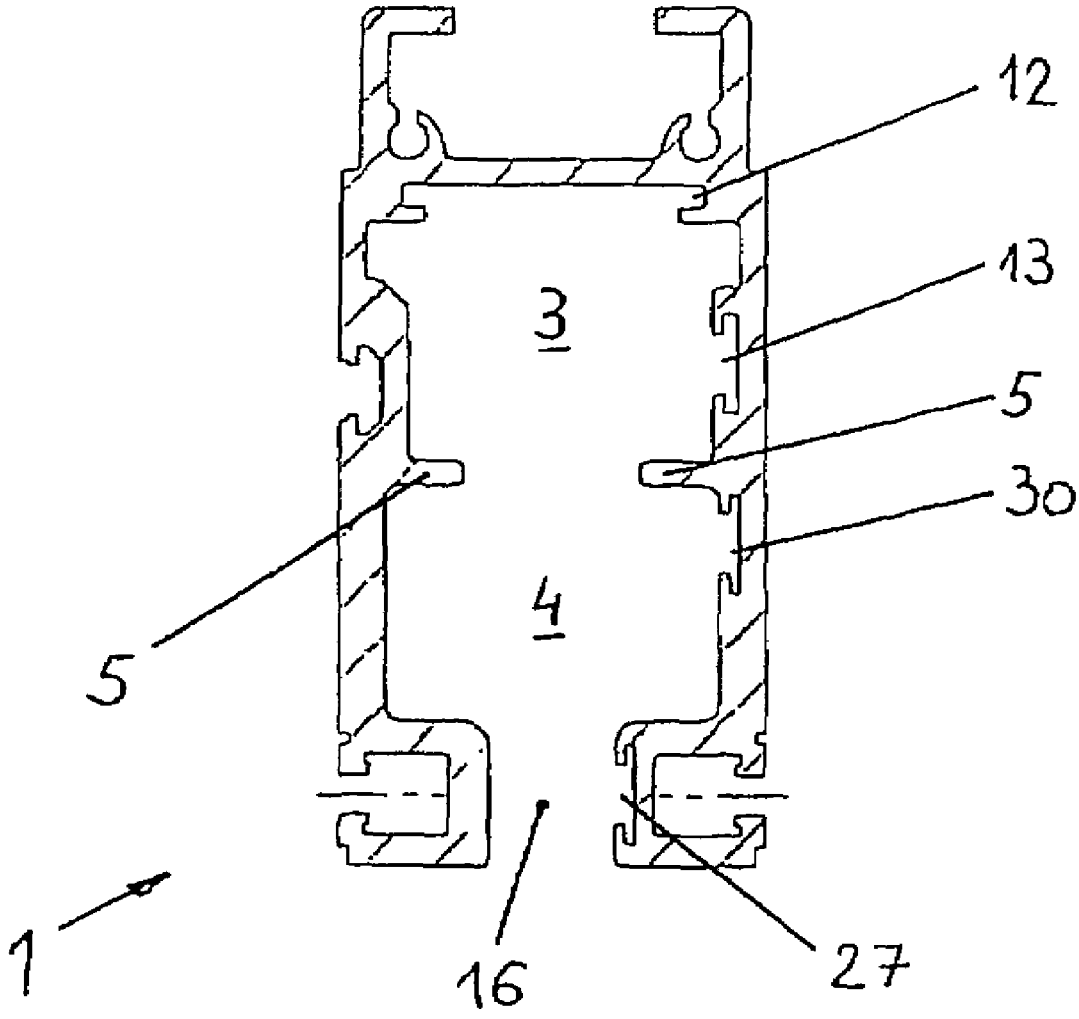

The invention concerns an overhead crane track and a profile member for an overhead crane track.

Crane track systems are frequently used in the automobile industry as conveyor systems for moving loads from one point to another or also as conveyor systems for automatic assembly apparatuses such as compressed air screwing tools, welding units, handling robots or the like use. In that respect increasing significance is being attributed to positionally accurate transport and travel detection in respect of the piece of equipment which is moved on the crane track. Finally, crane track systems should be comparatively simple to assemble and should be convertible having regard to a changing requirement profile.

In order to be able to implement accurate positional determination procedures and travel distance calculation, which is required in particular in automobile manufacture, controllability which is as precise as possible in respect of the drives for traveling carriages or trolleys is desirable. Guidance and drive thereof must be designed to be as precise as possible.

In known crane track systems the driven carriages are supported by way of support rollers arranged under the crane track profile member. Frequently the carriages are driven by way of friction wheels, and accurately determining the position of the carriage in question is difficult to achieve, due to slippage of the drive wheels under load. Crane track systems are known in which the carriages co-operate by way of drive pinions with a tooth arrangement which is provided externally on the crane track rail. That eliminates the problem of slippage when driven friction wheels are involved. It will be noted however that it is relatively complicated and expensive to provide tooth arrangements of that kind externally on the crane track rail, especially as the crane track rails usually comprise aluminum extruded profile members to which toothed rack members or drive bars of a harder metal have to be fitted.

Therefore the object of the present invention is to provide a completely novel overhead crane track in which the trolleys are precisely guided and are positionally accurately displaceable.

The object of the present invention is attained by an overhead crane track including at least one crane track rail and at least one carriage guided on the crane track rail, wherein the crane track rail is composed of a plurality of portions of a hollow profile member, the carriage is guided on a runway formed within the hollow profile member, the carriage has at least one electric drive which is supplied with power by way of a power feed provided within the hollow profile member and wherein the carriage is arranged displaceably by way of drive means which are arranged completely in the interior of the hollow profile member within same.

In accordance with the invention there is provided an overhead crane track comprising a crane track rail in which the power feed and parts of the drive means for the carriages are integrated. The carriages can be guided in tilt-resistant manner with their rollers within the profile member. The overall arrangement is structurally particularly compact and the drive means for the carriage are arranged in a protected condition within the crane track rail which is in the form of the hollow profile member so that this ensures trouble-free operation thereof.

Preferably the drive means is at least one toothed drive, wherein the toothed drive includes a drive bar into which engages at least one drive pinion on the carriage.

That ensures slip-free forward drive for the carriage.

If the carriage is not driven electrically, which is entirely within the scope of the present invention, the toothed drive can be used for exactly determining the position of the carriage. Exactly determining the position of the carriage in that way is desirable for example when ancillary assembly units are guided by way thereof, in a line assembly procedure. In that case the worker pulls the carriage for example with a compressed air-operated or electrically operated screwing tool mounted thereto behind him. The present position of the carriage can be exactly determined at any time by way of the integrated travel distance measurement means.

In a particularly preferred variant of the overhead crane track in accordance with the invention the drive bar is in the form of a fixedly arranged toothed belt which is tensioned in the interior of the hollow profile member. Such a toothed belt can be produced for example from plastic material. It can be comparatively easily fixed in the interior of the hollow profile member.

Preferably the toothed belt is pulled into a profile groove in the hollow profile member and is held in positively locking relationship thereby transversely with respect to the pulling direction.

It is particularly advantageous if the toothed belt is respectively fixed at its end, under a tensile force. That avoids slippage due to an increase in the length of or a variation in the position of the toothed belt.

If great lengths of the crane track rail are fitted, separation locations are installed in the crane track rail, in accordance with the temperature differences to be expected, to absorb shrinkage or expansion without altering the overall length of the rail. The portions of the crane track rail between the separation locations are in that case desirably suspended in sliding relationship.

Preferably the separation locations are each in the form of an inclined cut so that the runner wheels do not experience any bumping or jolting when passing over the rail join. Alternatively the separation location can be of a substantially v-shaped configuration in plan view.

Preferably at least one current bus bar is provided as the power supply, wherein the drive for the carriage has at least one current pick-up co-operating with the bus bar. The current pick-up can be for example in the form of a sliding contact.

In order to ensure that the carriage is also passively movable, it is advantageous if the drive pinion is mounted pivotably in such a way that it can be moved selectively into and out of engagement with the drive bar.

The hollow profile member can include at least a first profile chamber which is an upper profile chamber in the installation position and a second profile chamber which is a lower profile chamber in the installation position, wherein the first profile chamber desirably accommodates the power feed means and the drive means and the second profile chamber provides the runway for the carriage.

In order to ensure particularly tilt-resistant guidance for the carriage the runway is formed by profile member limbs which are upper and lower limbs in the installation position and which delimit a runner wheel passage, the height of which approximately corresponds to the diameter of the runner wheels. This means that the diameter of the runner wheels is only slightly smaller, for example by 0.5 mm, than the height of the runner wheel passage.

Preferably the cross-section of the crane track rail is approximately c-shaped, wherein the profile member opening of the c-shaped profile member, being a lower opening in the installation position, forms a slot for the passage therethrough of the load attachment means of the carriage.

In order to provide for guidance of the carriage transversely with respect to the direction of travel, it is possible to provide thereon centering rollers which are guided in the lower profile member opening or in the through slot.

In the preferred configuration of the overhead crane track according to the invention, it is in the form of a monorail overhead track, but it will be appreciated that it is also possible for it to be in the form of a multi-rail overhead track with a plurality of mutually parallel rail lines.

Further provided in accordance with the invention is a crane track profile member which is in the form of a hollow profile member and within which are provided at least one first chamber which is an upper chamber in the installation position and a second chamber which is a lower chamber in the installation position, wherein at one chamber is in the form of a runway for the runner wheels of a carriage and at least one chamber is adapted to accommodate the power feed means and at least a part of the drive means for the carriage.

The cross-section of the profile member can be of an approximately c-shaped configuration, in which case the profile member opening which is the lower opening in the installation position forms a slot for load attachment means of the carriage to pass therethrough.

Figure 2:
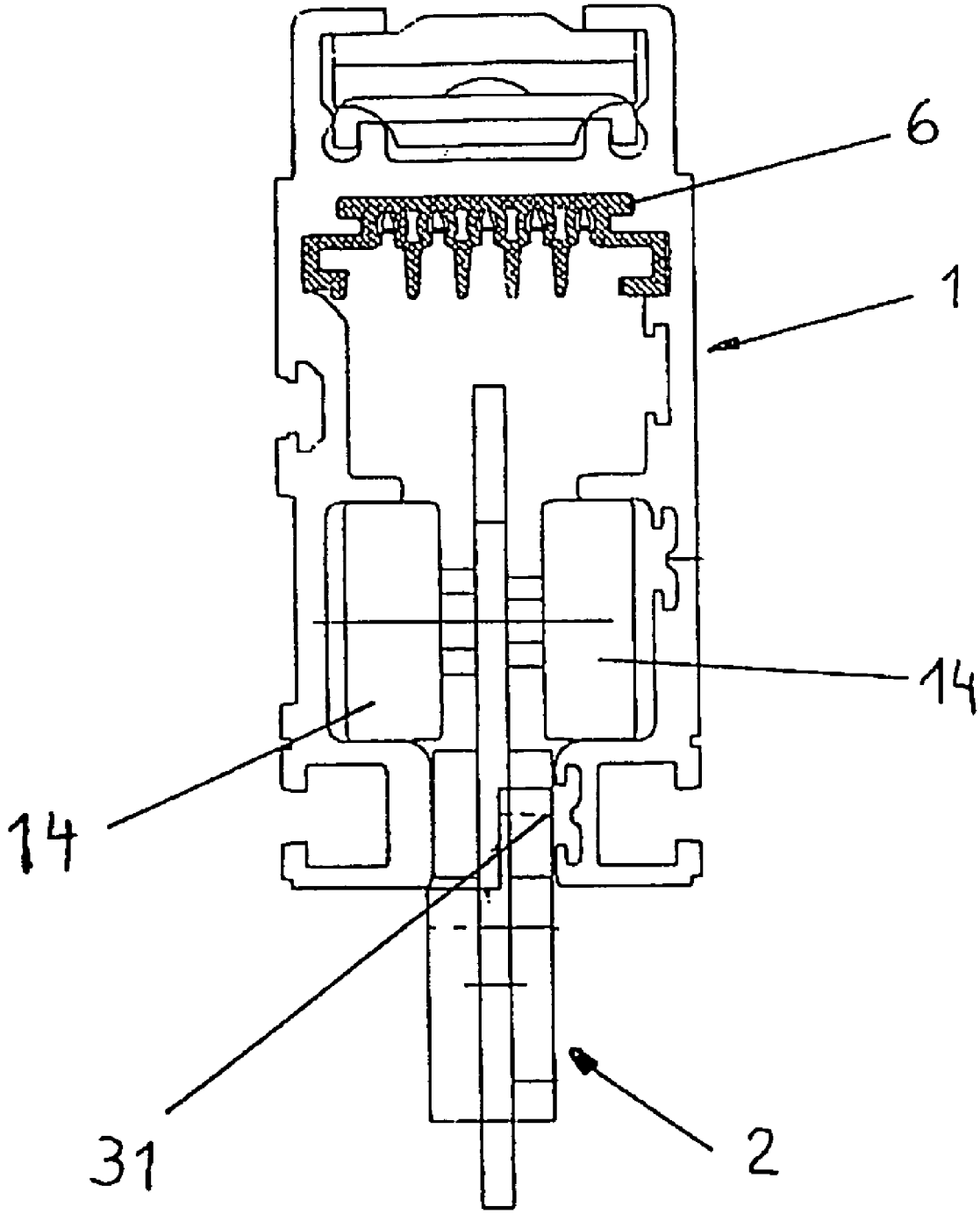
Figure 3:
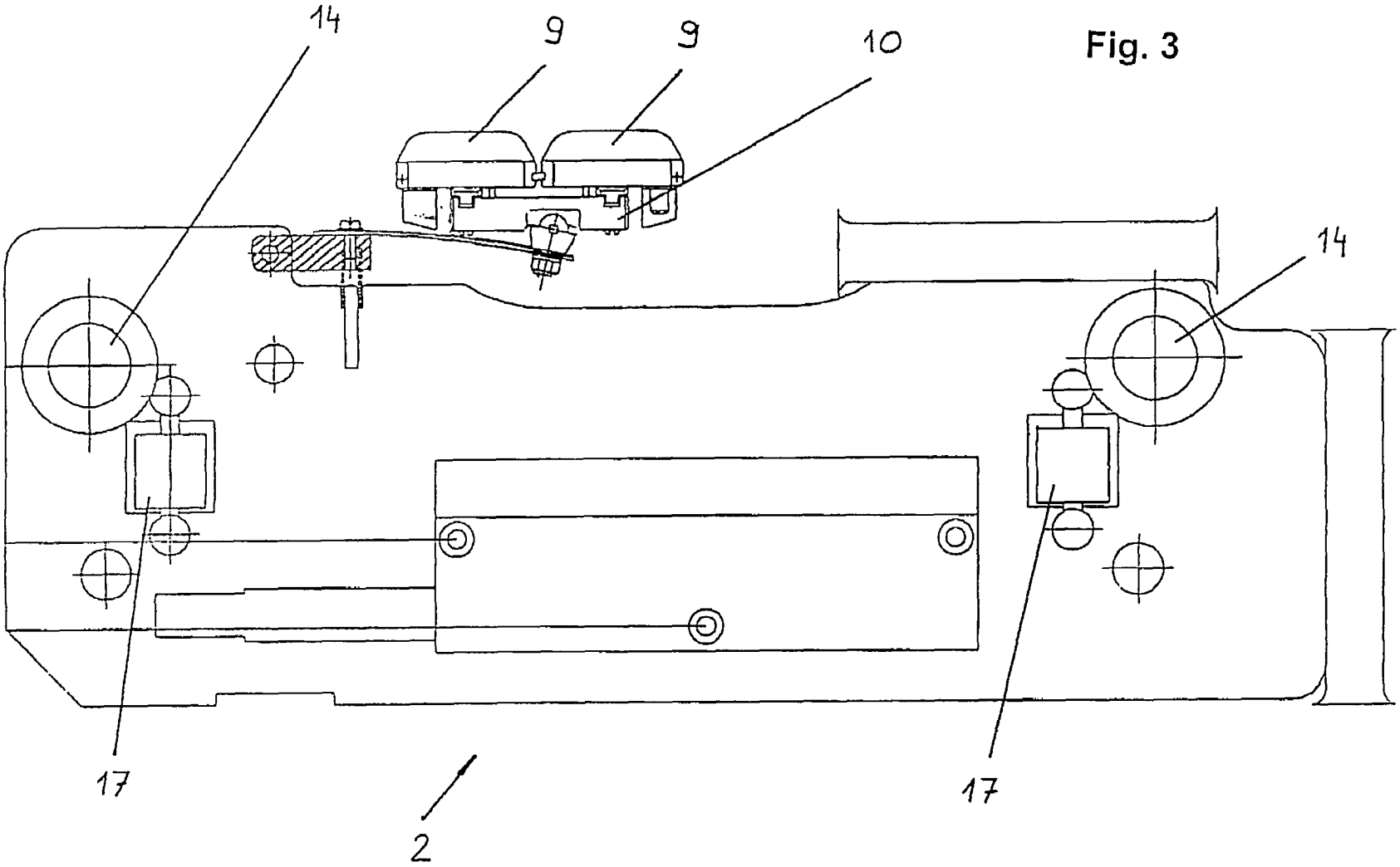
Figure 4:
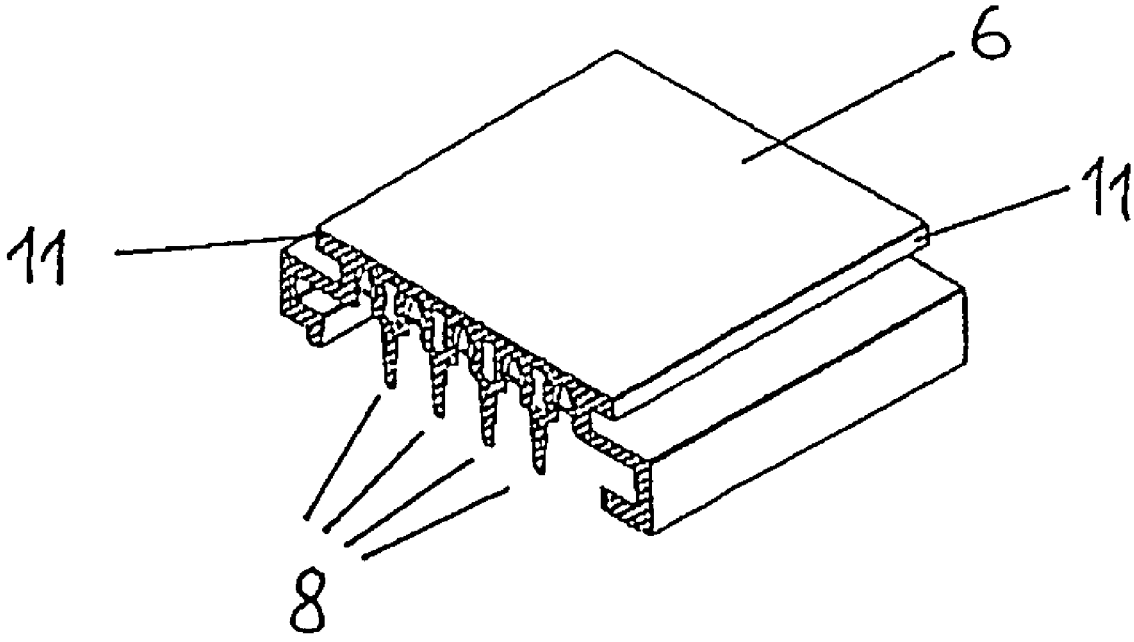
Figure 5:
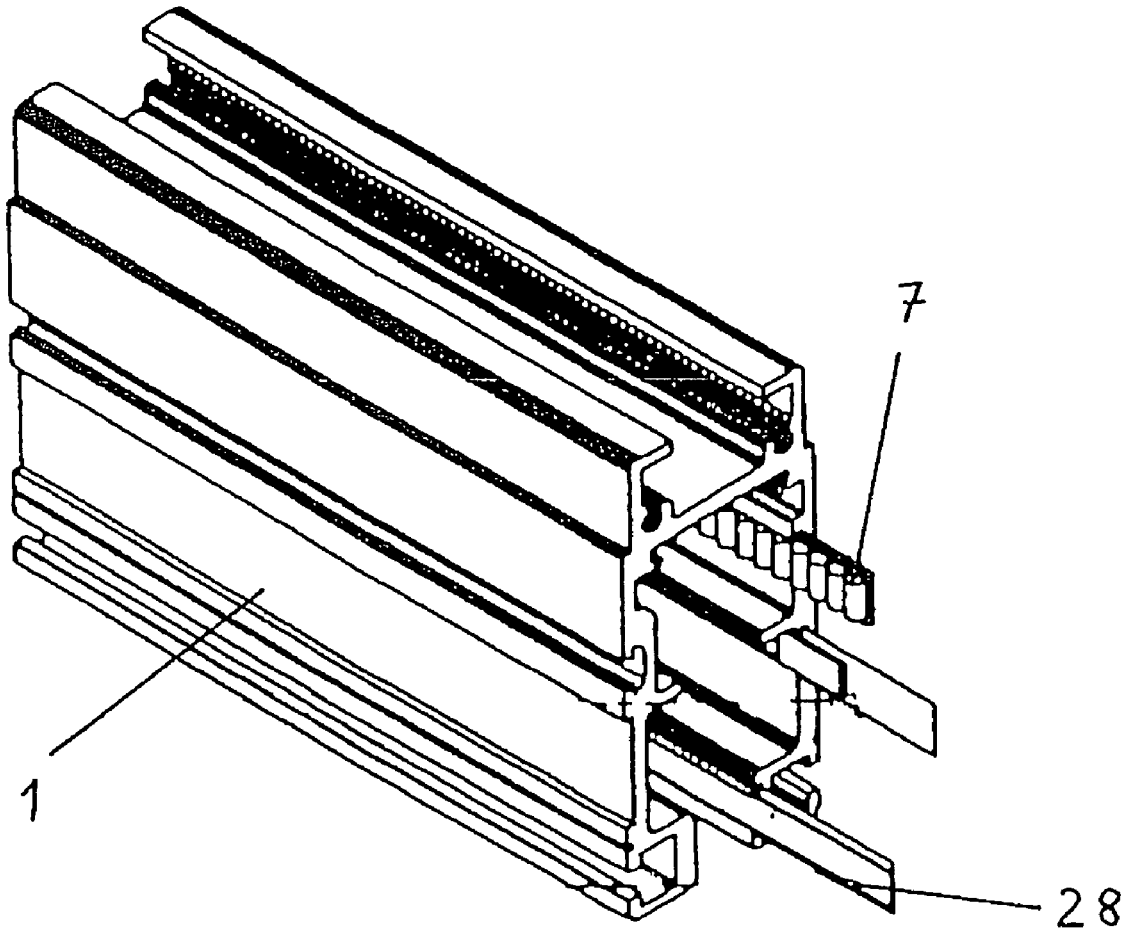
Figure 6:
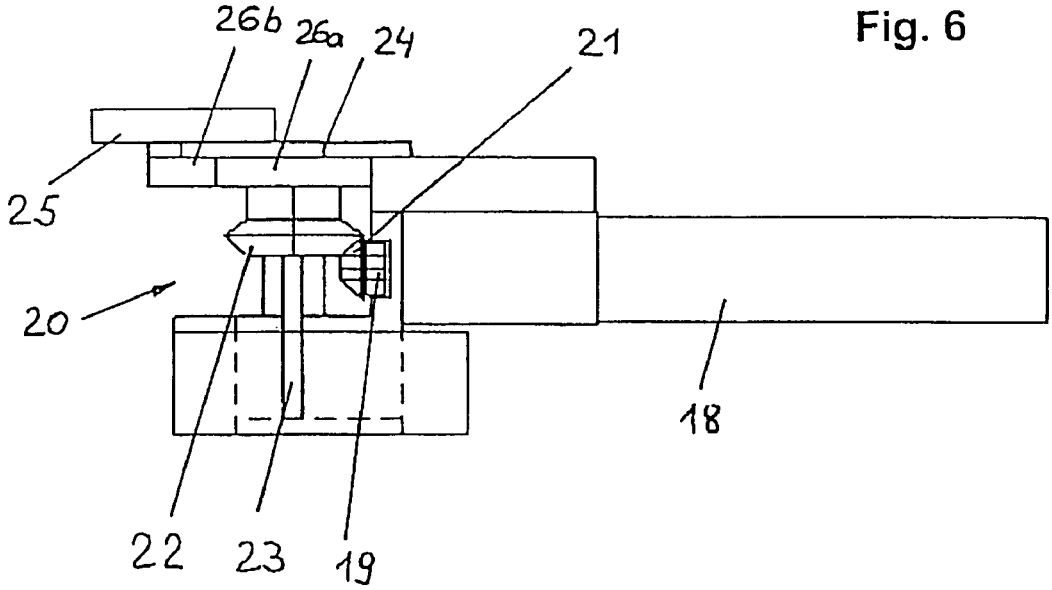
Figure 7:
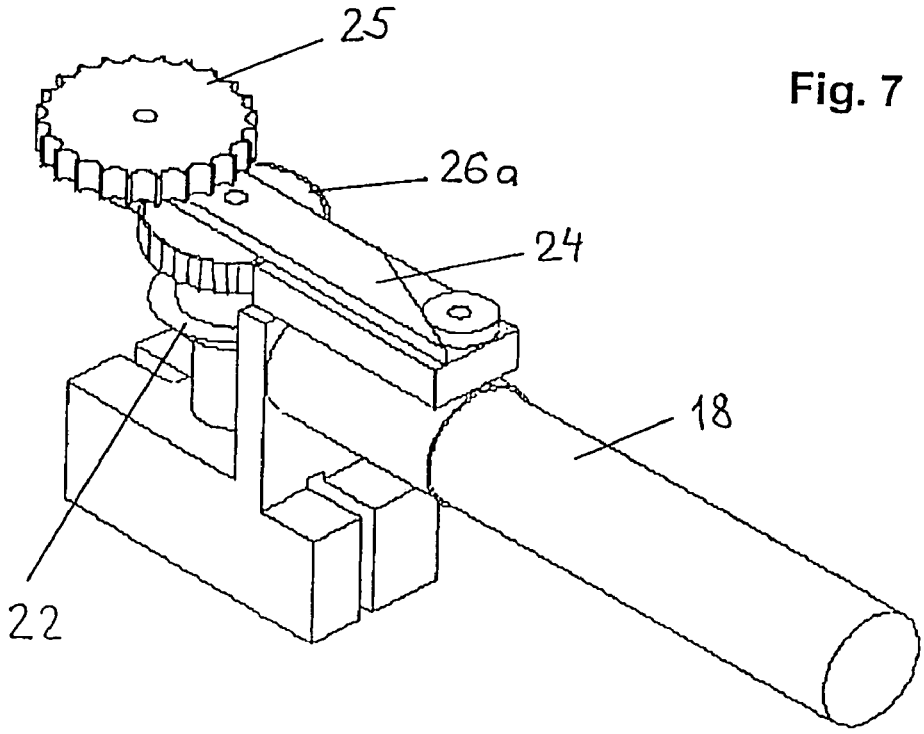

The invention is described hereinafter by means of an embodiment by way of example of the invention illustrated in the drawing in which:

FIG. 1 is a cross-section through a crane track rail of the overhead crane track according to the invention, FIG. 2 is a diagrammatic view, partly in section, of the crane track rail with the carriage fitted therein, FIG. 3 shows a view of the carriage, FIG. 4 shows a portion of the current bus bar fitted into the crane track rail, FIG. 5 shows a perspective view of a portion of the crane track rail, FIG. 6 shows a side view of the drive means of the carriage, and FIG. 7 shows a perspective view of the drive means of the carriage.

As can be readily seen from the Figures the overhead crane track according to the invention includes at least one crane track rail 1 and a carriage 2 which is guided on the crane track rail 1. The crane track rail 1 is in the form of a hollow aluminum profile member of approximately c-shaped cross-section, wherein provided within the hollow profile member is a first chamber 3 which is an upper chamber in the installation position and a second chamber 4 which is a lower chamber in the installation position. The chambers 3, 4 are separated from each other by inwardly directed profile member limbs 5. The first chamber 3 serves to accommodate a current bus bar 6 and a toothed belt 7 as drive means for the carriage 2.

The poles 8 of the current bus bar 6 are of such a configuration and are so oriented that the sliding contacts 9 of a current pick-up 10 arranged on the carriage 2 can engage between them.

To fix the current bus bar 6 within the first chamber 3, provided thereon is a dovetail guide 11 which can be inserted into a first groove passage 11 of a complementary configuration thereto.

Provided in the inner side wall of the profile member forming the crane track rail 1 is a second groove passage 13 which accommodates the toothed belt 7, as can be seen from FIG. 5. The second groove passage 13, like the first groove passage 12, is of a substantially c-shaped cross-sectional profile. The toothed belt 7 has a carrier belt which is somewhat wider than the teeth thereof so that the toothed belt 7 can be drawn in positively locking relationship into the second groove passage 13 so that the teeth face into the interior of the profile member. The toothed belt 7 is then secured under tension at its ends.

The second chamber 4 forms a runway or a runner wheel passage for the runner wheels 14 of the carriage 2. That runner wheel passage is formed at the topside by the upper profile member limbs 5 and at the lower side by lower profile member limbs or profile member legs 15. The spacing between the upper profile member limbs 5 and the lower profile member legs 15 is slightly larger than the diameter of the runner wheels 14 so that the carriage 2 is guided in tilt-resistant and stable manner within the profile member.

The profile member of the crane track rail, which is of a c-shaped configuration in cross-section, has a lower profile member opening which is in the form of a through slot 16 extending in the longitudinal direction of the profile member. The slot 16 serves on the one hand for passing therethrough a part of the carriage 2, to which loads or handling apparatuses can be attached, and on the other hand it serves for centering the carriage 2 by means of centering runners 17 provided on the carriage 2. The centering runners 17 roll on the internal surfaces formed by the slot 16.

The drive for the carriage 2 can be seen from FIG. 6. The carriage 2 includes an electric motor 18 which is supplied with current by way of the current bus bar 6 and the sliding contacts 9 of the current pick-up 10. The electric motor 18 drives by way of an output shaft 19 a bevel gear transmission 20. The bevel gear transmission 20 includes a spur gear 21 meshing with a bevel gear 22. The bevel gear 22 is connected non-rotatably to a shaft 23 which extends perpendicularly to the output shaft 19 and passes through a rocker member 24 which is mounted pivotably about the shaft 23 and which is pivotable about the shaft 23 by means of a control mechanism (not shown). Mounted rotatably on the rocker member 24 at the end thereof which is remote from the control mechanism is a drive pinion 25. The drive pinion 25 in turn is driven by a first auxiliary pinion **26*a* connected non-rotatably to the shaft 23, by way of a second auxiliary pinion 26*b*. The drive pinion 25 is moved selectively into and out of engagement with the toothed belt 7 by pivotal movement of the rocker member 24 about the shaft 23**.

Provided at an internal surface of the through slot 16 is a third groove passage 27 which accommodates a magnetic strip 28, by way of which incremental direct travel distance measurement is possible, by means of reading heads which are integrated in the carriage 2. The bottom of the third groove passage 27 is provided with a rib 29 which projects into the groove passage 27 so far that the magnetic strip is pressed against the front edge of the profile member in order to be able to preset an accurate position relative to the reading head 31 of the carriage 2. In addition the clearance of the upper and lower edges of the magnetic strip 28 guarantees that it can be easily pulled into the groove passage 27 in question over great lengths of the crane track rail 1.

Finally, reference 30 denotes a fourth groove passage which extends in the second chamber 4 and which is of a corresponding configuration to the third groove passage 27.

That fourth groove passage 30 can accommodate for example a further steel strip which can be fitted with magnet elements or magnetic strips of any length and which can be used for sensor purposes in respect of for example position detecting, switching functions, speed regulation procedures and so forth.

Over Crane Track and Overhead Crane Track Profile Member

LIST OF REFERENCES

1 crane track rail
2 carriage
3 first chamber
4 second chamber
5 upper profile member limbs
6 current bus bar
7 toothed belt
8 poles
9 sliding contacts
10 current pick-up
11 dovetail guide
12 first groove passage
13 second groove passage
14 runner wheels
15 profile member legs
16 through slot
17 centering runners
18 electric motor
19 drive shaft
20 bevel gear transmission
21 spur gear
22 bevel gear
23 shaft
24 rocker member
25 drive pinion
26*a, b* auxiliary pinion
27 third groove passage
28 magnetic strip
29 rib
30 fourth groove passage
31 reading head

The invention claimed is:

1. An overhead crane track including at least one crane track rail and at least one carriage guided on the crane track rail, wherein the crane track rail is composed of a plurality of portions of a hollow profile member, the carriage is guided on runner wheels in a runway formed within the hollow profile member, the carriage has at least one electric drive which is supplied with power by way of a power feed provided within the hollow profile member and the carriage is arranged displaceably by way of drive means arranged completely in the interior of the hollow profile member within same, wherein at least one toothed drive is provided as the drive means, the toothed drive including at least one drive bar into which at least one drive pinion on the carriage engages, wherein the drive portion is mounted pivotably in such a way that it can be moved selectively into and out of engagement with the drive bar.

2. An overhead crane track as set forth in claim 1 characterized in that a fixedly arranged toothed belt which is tensioned in the interior of the hollow profile member is provided as the drive bar.

3. An overhead crane track as set forth in claim 2 characterized in that the toothed belt is drawn into a profile member groove in the hollow profile member and is held in positively locking relationship thereby transversely with respect to the pulling direction.

4. A overhead crane track as set forth in claim 2 characterized in that the toothed belt is fixed under a tensile stress at each end.

5. An overhead crane track as set forth in claim 1 characterized in that at least one current bus bar is provided as the power feed and that the drive for the carriage has at least one current pick-up co-operating with the current bus bar.

6. An overhead crane track as set forth in claim 1 characterized in that the runway is formed by profile limbs or profile legs which are upper and lower limbs or legs in the installation position and which delimit a runner wheel passage, the height of which approximately corresponds to the diameter of the runner wheels.

7. An overhead crane track as set forth in claim 1 characterized in that the cross-section of the crane track rail is of a substantially c-shaped configuration, wherein the profile member opening which is a lower opening in the installation position forms a slot for load attachment means of the carriage to pass therethrough.

8. An overhead crane track as set forth in claim 1 characterized in that the carriage has centering rollers which are guided in the lower profile member opening.

9. An overhead crane track as set forth in claim 1 characterized in that it is the form of a monorail overhead track.

* * * * *